US005489021A

United States Patent [19]

Wallingford

[11] Patent Number: 5,489,021

[45] Date of Patent: Feb. 6, 1996

[54] MULTIPURPOSE CARRYING CASE

[76] Inventor: Denise L. Wallingford, 4026 SE. Conifer Park Dr., Port Orchard, Wash. 98366

[21] Appl. No.: 444,374

[22] Filed: May 18, 1995

[51] Int. Cl.[6] ..... B42F 7/04

[52] U.S. Cl. ..... 206/214; 206/576; 206/232; 206/473

[58] Field of Search ..... D3/233; D19/26, D19/27; 206/214, 576, 232, 425, 450, 472, 473; 150/106, 112, 113, 117

[56] References Cited

U.S. PATENT DOCUMENTS

| | | | |
|---|---|---|---|
| D. 75,202 | 5/1928 | Wolf . | |
| D. 160,147 | 9/1950 | Chase . | |
| D. 183,711 | 10/1958 | Blaivas . | |
| D. 323,528 | 1/1992 | Anderson | D19/27 |
| 1,895,018 | 1/1933 | Wolf . | |
| 3,133,631 | 5/1964 | Bolden | 206/232 X |
| 4,161,201 | 7/1979 | Carp . | |
| 4,306,737 | 12/1981 | Errichiello | 206/472 X |
| 4,423,834 | 1/1984 | Rush . | |
| 4,874,340 | 10/1989 | Smallwood . | |
| 4,961,522 | 10/1990 | Weber . | |
| 5,036,973 | 8/1991 | Aida | 206/214 |
| 5,190,127 | 3/1993 | Cummings . | |
| 5,217,119 | 6/1993 | Hollingsworth . | |
| 5,294,208 | 3/1994 | Tremmel, Jr. et al. . | |
| 5,366,070 | 11/1994 | Wolov | 206/214 |
| 5,377,887 | 1/1995 | Garcia . | |

FOREIGN PATENT DOCUMENTS

| | | |
|---|---|---|
| 857965 | 1/1961 | United Kingdom . |
| 2232639 | 12/1990 | United Kingdom . |

*Primary Examiner*—Jacob K. Ackun
*Attorney, Agent, or Firm*—Richard C. Litman

[57] ABSTRACT

A multipurpose carrying case made up of a main compartment in which a binder with a ring has been mounted, which allows a user to secure hole-punched leaves and other business-related items. A pocket and a flap attached to the exterior of the main compartment may be used to secure other objects, thereby giving a user convenient access to especially-needed items without requiring opening of the compartment. Fasteners within the compartment and underneath the flap permit the user to attach to the carrying case small purses in which personal effects might be kept.

11 Claims, 3 Drawing Sheets

MULTIPURPOSE CARRYING CASE

BACKGROUND OF THE INVENTION

1. Field of the Invention

The present invention relates to carrying cases which enclose any relatively flat hole-punched item as well as irregularly shaped loose items and to which numerous small pouches are attached to both the interior and to the exterior of the case.

2. Description of the Prior Art

Ironically, the modern symbols of achievement and position, the briefcase and the personal organizer, often are burdens to the professional workers who must carry them. The female professional may by further encumbered by a purse or wallet. Although ring binders may be the most convenient fasteners for flat hole-punched items such as transparencies or manuals, they may be bulky and inconveniently shaped, thus still further compounding the difficulties in carrying business-related materials.

Unless one's briefcase is roomy enough to accommodate the other items safely, the professional must tote them all about individually, sometimes struggling to keep hold of all the possessions. Items may be dropped in public transit systems, forgotten in vehicles, and misplaced at the most inopportune moment. At worst, the struggle to convey all the items to their intended destinations is simply impossible; at best, it is annoying. Although tremendously convenient and popular with students, until the backpack has become a dignified boardroom feature it probably is not an option for the professional. The extreme option of leaving one's possessions at home, thereby obviating the struggle to carry them, is simply not a meaningful choice and may lead to more inconvenience than has been eliminated.

Although combinations of purses, cases and accessories have been devised to alleviate some of this aggravation, no combination provides the advantages of the present invention, and no combination adequately meets the demands faced by professional workers who must carry several disparately-shaped business materials and personal effects.

U.S. Pat. No. 4,161,201, issued to Bess Carp on Jul. 17, 1979, reveals a combination carrying case and article organizer assembly especially adapted for the traveler. The case is a rectangular piece of luggage to which a shoulder strap is attached and into which a number of article organizers may be fixed. The article organizers are flat pouches having various pocket and zipper configurations which allow the traveler to store such items as travelers checks, credit cards and the like. However, the case has no means for securing flat hole-punched leaves. Moreover, because all items carried by the case are necessarily located in the interior of the case, a user must open the case fully to retrieve a desired item.

U.S. Pat. No. 5,217,119, issued to Dale Hollingsworth on Jun. 8, 1993, shows a carrying case which is designed to carry a laptop computer. The case comprises a main compartment which is adapted for receiving, suspending and protecting a laptop computer. A flap with a buckle may be used to seal the compartment. It may further comprise compartments mounted to the exterior surfaces of the main compartment panels. A shoulder strap and a handle provide carrying means. Although well-suited to carrying a laptop computer and its attendant paraphernalia, the case lacks means for keeping hole-punched items organized and stationary or for securing items such as purses or writing implements. Moreover, the main compartment does not open flat, but rather, opens only at the top, so that the use of a ring binder in this case would be seriously hampered.

U.S. Pat. No. Des. 183,711, issued to Marilyn Blaivas on Oct. 21, 1958, shows a combined autographed handbag, wallet and loose leaf ring binder. Although styled a "handbag", the device is really no more than a two-ring binder fixedly mounted to a panel to which two side panel members are flexibly attached. Carrying handles are attached to the panels. Items are held by the handbag either by fastening them directly to the ring binder or by placing them within pouches fastened to the ring binder. The handbag cannot be completely sealed and, therefore, cannot contain any loose items.

U.S. Pat. No. 5,190,127, issued to Don E. Cummings on Mar. 2, 1993, describes a storage device and organizer for card collections. The device consists of a case in which a three ring binder has been attached. Compartments built into the case provide storage spaces for variously shaped items, whereas the three-ring binder may be used to secure any leaf which has been hole punched. The case may be latched shut and carried by a handle. All items must be carried in the case interior. As with the carrying case in the Carp patent, the user must open the case in order to retrieve an item. Partitioning of the case into smaller compartments necessarily prevents a user from storing an oversized leaf on the binder.

U.S. Pat. No. 1,895,018, issued to Charles Wolf on Jan. 24, 1933, discloses a handbag whose compartment space is adapted to hold a novel. When closed, the handbag completely encloses small personal effects as well as a book. When opened, the handbag permits the user to hold the book opened flat in one hand. Numerous pockets are attached to the side of the handbag and may be covered by a securing flap. The size of the bag does not permit the inclusion of the ring binder as in the instant invention. Moreover, the bag is specifically adapted to secure a book rather than a randomly-sized leaf. Although its numerous pockets provide storage space for the user, the bag has no provisions for securing ancillary pouches or purses. U.S. Pat. No. Des. 75,202, issued to Walter F. Wolf on May 22, 1928, shows another combination book holder and pocket book with the same limitations as those found in the book holder in the Wolf '018 patent.

U.S. Pat. No. 4,961,522, issued to Randi R. Weber on Oct. 9, 1990, describes a utility travel pack for carrying a baby's needs. Because of its sheer volume, the utility travel pack is capable of engulfing smaller bags. The travel pack is convertible from a hand-carried mode to either a shoulder-carried or a back-carried mode. Besides being inconveniently sized for business purposes, the bag lacks means for attaching smaller bags to its exterior surface, thus requiring a user to rummage through its interior to find smaller bags contained therein. The bag also lacks a binder having a ring for receiving hole-punched items.

U.S. Pat. No. 5,377,887, issued to Lawrence Garcia on Jan. 3, 1995, shows a piece of travel luggage which may be converted from a handbag to a backpack. British Patent No. 857,965, issued to Albert P. Lewin on Jan. 4, 1961, shows a satchel having handles which may be converted into a backpack. Neither of these devices is combined with a ring binder. Although the backpack in the Garcia patent may have an extensible pocket affixed to an exterior surface, items placed therein cannot be organized or immobilized other than by stuffing them in tightly. Oversized articles cannot be contained in the pocket. The satchel in Lewin's patent lacks even an exterior pocket such as this.

U.S. Pat. No. Des. 160,147, issued to Herbert S. Chase on Sep. 19, 1950, demonstrates a ladies' purse which has a key holder and an assembly of transparent holders for securing photographs. Pockets in the purse may hold small personal effects; however, the purse is clearly unsuited to holding business articles. Although a key holder may consist of a ring, it is an inappropriate means for holding hole-punch leaves in combination with this ladies' purse.

Further, relatively remote disclosures include those seen in U.S. Pat. No. 4,423,834, issued to Anne K. Rush on Jan. 3, 1984; U.S. Pat. No. 4,874,340, issued to Alice R. Smallwood on Oct. 17, 1989; and U.S. Pat. No. 5,294,208, issued to Richard J. Tremmel, Jr. et al. on Mar. 15, 1994. The Rush patent discloses a backpack which converts into a cape for a stuffed bear. Not only does this device lack any means for holding or organizing any business related materials, but also it cannot be converted to a handbag configuration. The Smallwood patent discloses a transport and storage pack to which a stuffed toy is permanently attached and a story printed on cloth material is temporarily attached. As with the Rush patent, this device is not designed to enclose business materials but rather to provide a convenient means for toting a child's amusements. The Tremmel, Jr. et al. patent discloses a notebook-type personal organizer which belongs in the same general class as the personal organizers the instant invention is designed to replace. The device is not a carrying case nor may it be converted into one.

None of the above inventions and patents, taken either singly or in combination, is seen to describe the instant invention as claimed.

SUMMARY OF THE INVENTION

The present invention overcomes the limitations of the devices described above and addresses the need of the professional worker to safely and conveniently transport variously-shaped articles to and from work. The invention includes a main compartment in which a binder having a ring is attached and which is roomy enough to enclose business-related and personal materials. A flap attached to the outside surface may be partially or completely sealed and may be used to hold items in place. Multiple fasteners for a variety of purses may be located within the main compartment and also on the exterior surface of the compartment underneath the flap. An exterior pocket is attached to the exterior side of the compartment opposite that on which the flap is attached. Ideally, the carrying case may be convertible from a hand- or shoulder-carrying configuration to a backpack configuration. The combination compartment with interior binder fastener, external flap, external pocket and attached purses provides the user with a single carrying case that is capable of carrying any business-related or personal item except for extremely oversized articles.

Accordingly, it is a principal object of the invention to provide a multipurpose carrying case dimensioned and configured to secure hole-punched items, other business-related materials and personal effects within a sealable compartment.

It is another object of the invention to provide a means for securing other items to the exterior surface of the compartment, so that although they are affixed to the carrying case, they are readily available to the user who need not open the compartment to retrieve them.

It is another further object of the invention to provide purses which are attachable to the carrying case and which may replace other purses and wallets.

It is another further object of the invention to provide a pocket attached to the exterior surface of the compartment which may be used to provide immediate access to items stuffed therein.

It is a still further object of the invention to marry the convenience of a backpack with the more traditional configuration of a briefcase or satchel.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
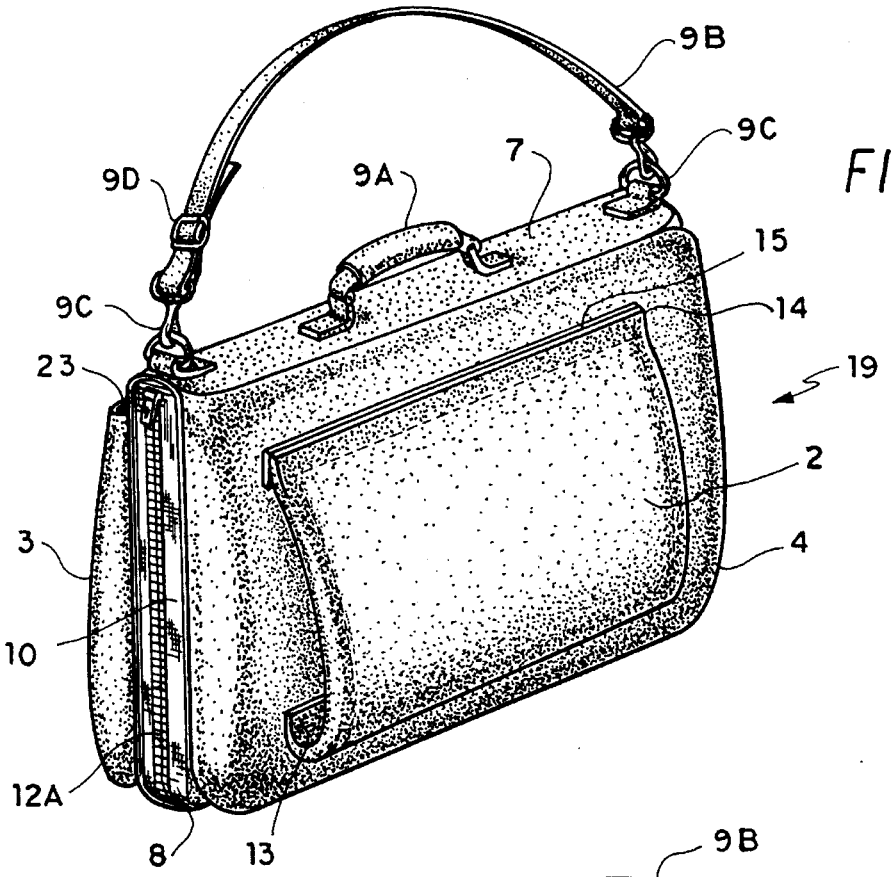
FIG. 1 is a perspective view of the carrying case of the present invention with the external flap sealed and facing forward.

The present invention is a multi-purpose carrying case which carries all but the most oversized business-related materials and functions as a personal organizer, purse and attache case. Referring to FIGS. 1–6 in greater detail, the carrying case 19 according to the invention includes a main compartment i which is roughly the size of an attache case. With particular reference to FIGS. 1 and 5, the main compartment i has an exterior surface 4, an interior surface 5 defined by a first side panel member *6a*, a second side panel member *6b*, a top panel member 7, a bottom panel member 8 a front panel member 10 and a rear panel member 11, the interior of which is seen in FIG. 3. With the exception of the top panel member 7, all panel members may be constructed from well known and suitable flexible materials such as animal hide, fabrics and synthetics, to name but a few. If a stiffer, more protected case is preferred, the panel members may also be constructed from or include stiffening materials such as wood, metal, hard plastics, etc., and these stiffening materials may then be covered with a fabric, synthetic or animal hide.

As more particularly shown in FIG. 5, which reveals the interior surface 5 of the main compartment 1, and in the sectional view of FIG. 3, the top panel member 7 is substantially flat and rigid. A binder with a ring 18 that may be used to fasten hole-punched items (shown in phantom) is attached to the interior surface of the top panel member 7 and is contained within the main compartment 1. For illustrative purposes, the binder 18 shown in FIG. 5 has three rings; however, the actual number of rings may vary according to individual taste to accommodate different hole-punch spacings. For further illustrative purposes, built-in zippers 12*a* and 12*b* extend through the front panel member 10, the bottom panel member 8 and the rear panel member 11 and is used to seal the main compartment 1. The zippers 12*a* and 12*b* could be replaced with other sealing means such as velcro® strips, buttons and buttonholes, snap fasteners or the like. Whichever form is chosen, the sealing means must close the main compartment 1 completely. The first side panel member 6*a* and second side panel member 6*b* are flexibly joined to side edges 20 and 21 of the top panel member 7 so that when the zippers 12*a* and 12*b* are unzipped and the main compartment 1 is opened, the top panel member 7 lies flat. The first side panel member 6*a* and second side panel member 6*b* also lie flat and disposed to the sides of the top panel member 7. Pouches 16*d* and 16*e* according to a user's taste may be secured within the main compartment 1 by fasteners 17*d* and 17*e* shown in phantom. In this embodiment, a loop 22 is attached to the interior surface 5 and can be used to hold a writing implement.

Figure 2:
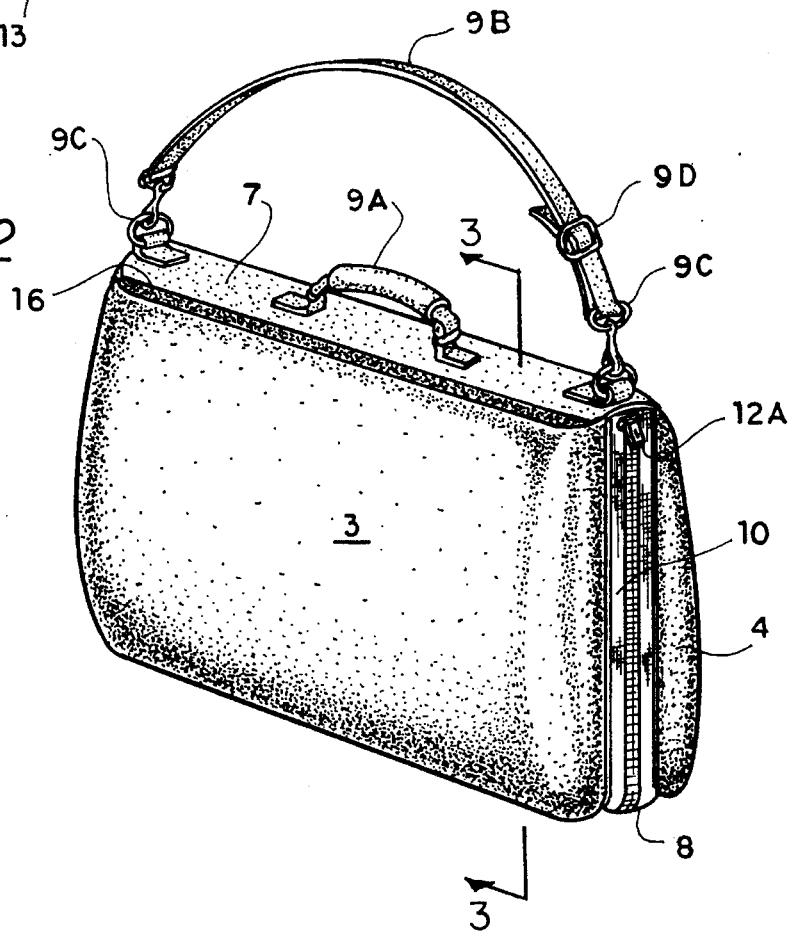
FIG. 2 is a perspective view of the carrying case with the external pocket facing forward.
Figure 3:
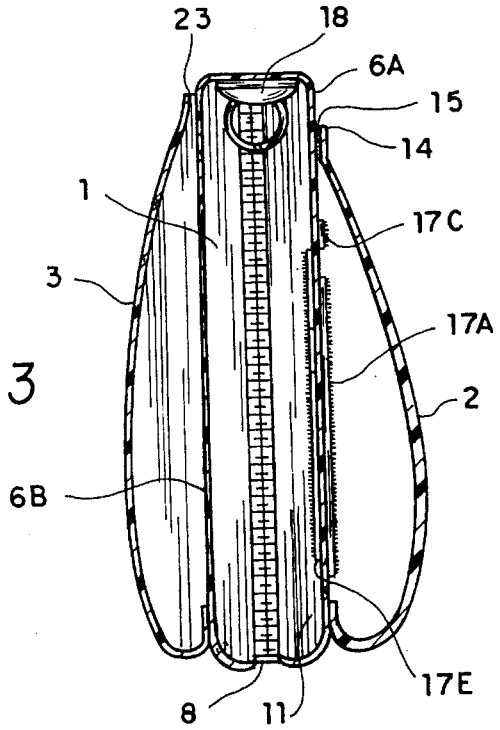
FIG. 3 is a sectional view taken along lines 3—3 of FIG. 2.

As best seen in FIG. 2 and in the cross sectional view in FIG. 3, a pocket 3 is attached to the exterior surface 4 of the main compartment 1. The pocket 3 consists of a rectangular piece of material which has been permanently attached to side panel member 6*b*. All edges of the material are attached except for one open edge 23 which permits one to put relatively flat items into the pocket 3.

Referring now to FIG. 1, a flap 2 is attached to the exterior surface 4 of the main compartment 1. The flap 2 consists of another rectangular piece of material which is relatively flexible. One edge 13 of the flap 2 is permanently attached to side panel member 6*a*. Another edge 14 of the flap 2 may be temporarily fastened to the side panel member 6*a*.

Figure 4:
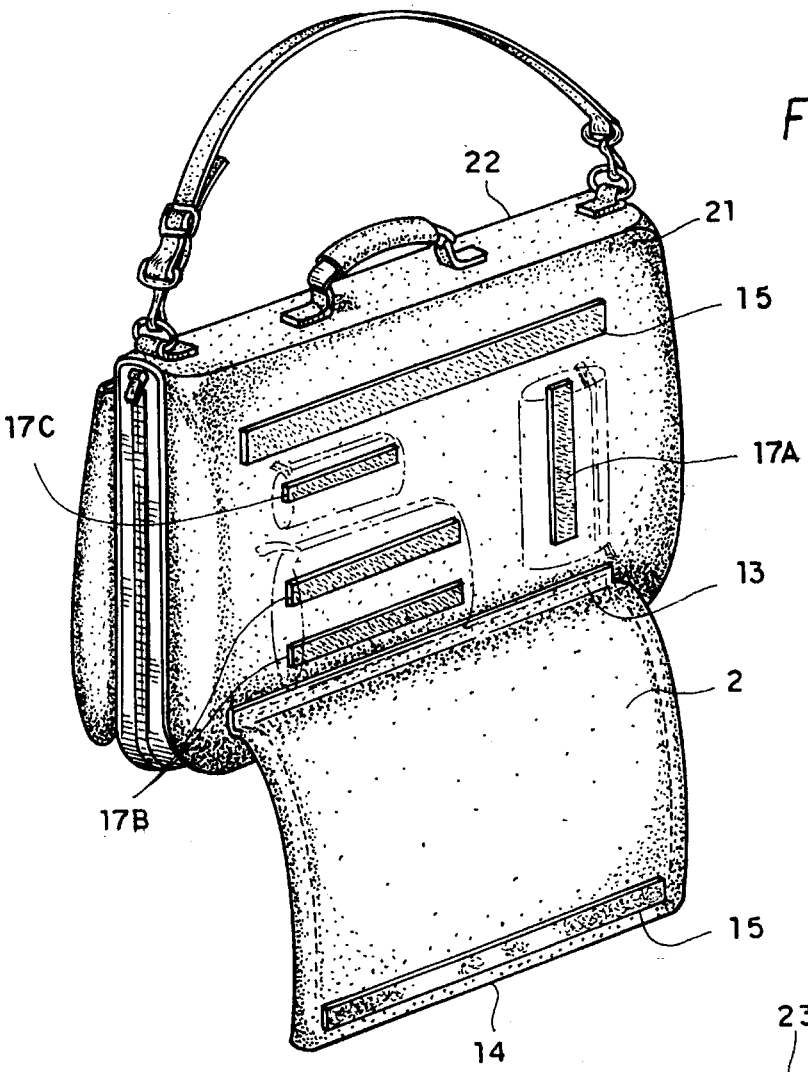
FIG. 4 is a perspective view similar to FIG. 1, but with the external flap opened to reveal attached external purses shown in phantom lines.
Figure 5:
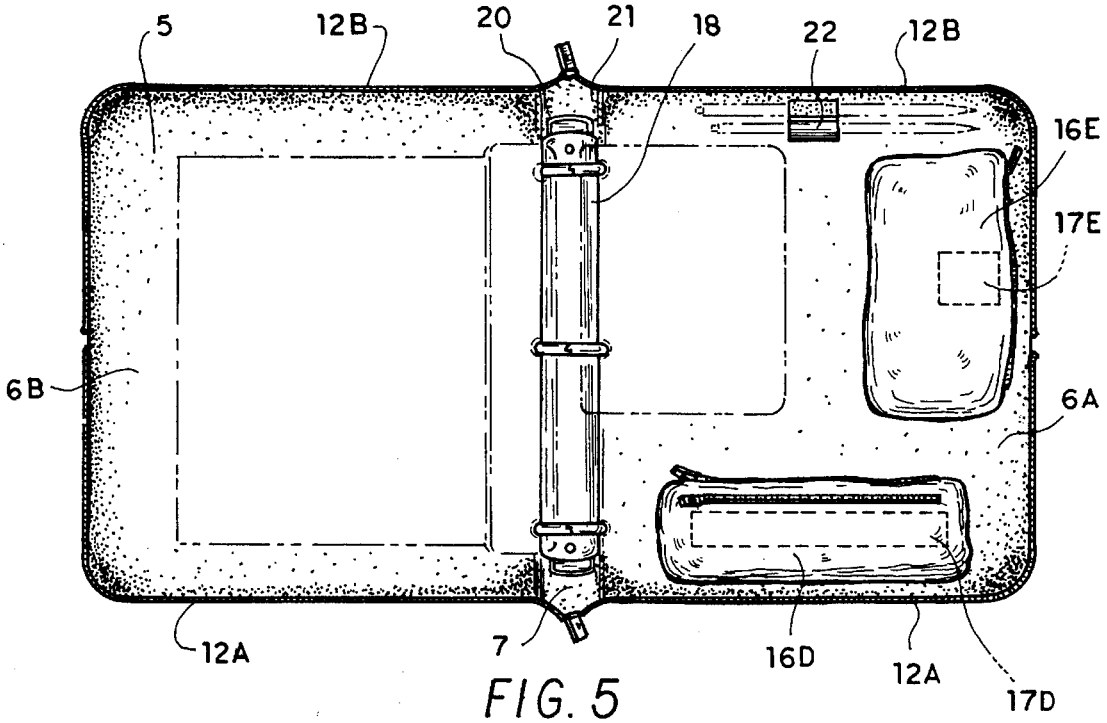
FIG. 5 is a plan view of the carrying case with the main compartment opened; a folder, a personal organizer, writing implements and velcro fasteners are shown in phantom lines.
Figure 6A:
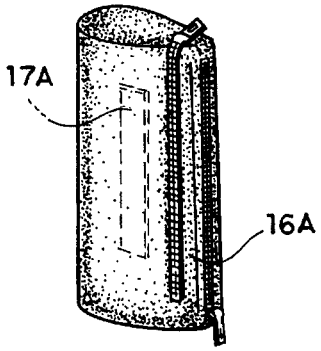
FIGS. 6A, 6B and 6C are front, rear and rear elevational views, respectively, of some of the external purses showing attachment means; a velcro® attachment is shown in phantom lines in FIG. 6A.
Figure 6B:
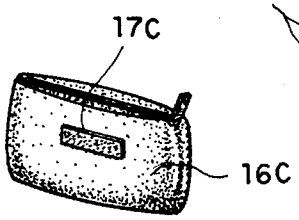
Figure 6C:
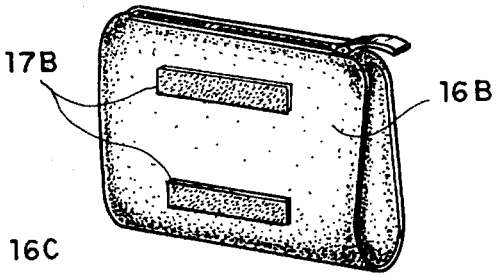

The view in FIG. 4 shows the carrying case 19 with the flap 2 opened to reveal temporary fastening means 15 for the flap edge 14. An assortment of pouches 16*a*, 16*b* and 16*c* shown in FIG. 6 also may be fastened temporarily to side panel 6*a* with similar fasteners 17*a*, 17*b* and 17*c*. As illustrated, velcro® is the preferred fastening means used for 15 and 17*a*–17*e* but could be replaced by such fastening devices as buttons, hooks or snap fasteners. The external arrangement of the flap 2 and pouches 16*a*, 16*b* and 16*c* enable one to quickly store and retrieve especially needed items without having to open the main compartment.

A handle 9*a* is attached to the exterior surface of the top panel member 7 as with a standard attache case. Moreover, a detachable and adjustable carrying strap 9*b*, shown here with a buckle 9*d* to permit length adjustment, may be connected to securing means 9*c* attached to the top panel member 7. If desired, two more auxiliary carrying straps could be attached to the exterior surface 4 of the main compartment 1 to allow one to carry the carrying case 19 as though it were a backpack.

It is to be understood that the present invention is not limited to the sole embodiment described above, but encompasses any and all embodiments within the scope of the following claims.

I claim:

1. A multipurpose carrying case comprising:

a sealable case having an exterior surface, an interior surface, a bottom panel member, a front panel member, a rear panel member, a substantially flat and rigid top panel member having an interior surface, an exterior surface and two opposing side edges, a first and second side panel member, said side panel members having an exterior surface and said side panel members being flexibly attached to said opposing side edges of said top panel member;

a binder having a ring fixedly mounted to said interior surface of said top panel member;

a handle fixedly mounted to said exterior surface of said top panel member;

a first flap having a plurality of edges, one edge of said plurality of edges being permanently attached to said exterior surface of said first side panel member;

a fastener for releasably securing at least one other edge of said plurality of edges of said first flap to said first side panel member; and a pocket, said pocket comprising a second flap having a plurality of edges, all but one edge of said plurality of edges being permanently attached to said exterior surface of said second side panel member.

2. The multipurpose carrying case of claim 1, further comprising:

a plurality of small pouches, said plurality of small pouches being removably attachable to a plurality of fasteners, said plurality of fasteners being located on said interior surface of said sealable case and on said exterior surface of said first side panel member.

3. The multipurpose carrying case of claim 2, further comprising:

an adjustable length carrying strap, said carrying strap removably fastened to said exterior surface of said top panel member and being suitable for shoulder-carrying over one shoulder said multipurpose carrying case.

4. The multipurpose carrying case of claim 3, further comprising:

a pair of adjustable straps, in addition to said adjustable length carrying strap, said pair of adjustable straps being attached to said exterior surface of said multipurpose carrying case and being suitable for shoulder-carrying over both shoulders, said multipurpose carrying case in the fashion of a backpack.

5. The multipurpose carrying case of claim 1, further comprising:

an adjustable length carrying strap, said carrying strap removably fastened to said exterior surface of said top panel member and being suitable for shoulder-carrying over one shoulder said multipurpose carrying case.

6. The multipurpose carrying case of claim 5, further comprising:

a pair of adjustable straps, in addition to said adjustable length carrying strap, said pair of adjustable straps being attached to said exterior surface of said multipurpose carrying case and being suitable for shoulder-carrying over both shoulders said multipurpose carrying case in the fashion of a backpack.

7. The multipurpose carrying case of claim 1, wherein said panel members defining said sealable case are constructed from rigid, impact-resistant material.

8. The multipurpose carrying case of claim 7 wherein said panel members are fabricated of a material selected from the group consisting of fabric, synthetic material and animal hide.

9. The multipurpose carrying case of claim 8, further comprising:

a plurality of small pouches, said plurality of small pouches being removably attachable to a plurality of fasteners, said plurality of fasteners being located on said interior surface of said sealable case and on said exterior surface of said first side panel member.

10. The multipurpose carrying case of claim 9, further comprising:

an adjustable length carrying strap, said carrying strap removably fastened to said exterior surface of said top panel member and being suitable for shoulder-carrying over one shoulder said multipurpose carrying case.

11. The multipurpose carrying case of claim 10, further comprising:

a pair of adjustable straps, in addition to said adjustable length carrying strap, said pair of adjustable straps being attached to said exterior surface of said multipurpose carrying case and being suitable for shoulder-carrying over both shoulders, said multipurpose carrying case in the fashion of a backpack.

* * * * *